United States Patent [19]

Dorn et al.

[11] 4,047,900

[45] Sept. 13, 1977

[54] MOTOR FUEL COMPOSITION

[75] Inventors: Peter Dorn, Lagrangeville; Walter D. Foucher, Jr., Fishkill, both of N.Y.

[73] Assignee: Texaco Inc., New York, N.Y.

[21] Appl. No.: 676,773

[22] Filed: Apr. 14, 1976

[51] Int. Cl.[2] ..... C10L 1/22

[52] U.S. Cl. ..... 44/68; 44/71

[58] Field of Search ..... 44/58, 68, 69, 71

[56] References Cited

U.S. PATENT DOCUMENTS

| | | | |
|---|---|---|---|
| 3,112,789 | 12/1963 | Percy et al. | 44/68 |
| 3,127,351 | 3/1964 | Brown et al. | 44/76 |
| 3,773,479 | 11/1973 | Dorn et al. | 44/71 |

FOREIGN PATENT DOCUMENTS

| | | | |
|---|---|---|---|
| 865,343 | 4/1961 | United Kingdom | 44/68 |

*Primary Examiner*—Daniel E. Wyman
*Assistant Examiner*—Mrs. Y. Harris-Smith
*Attorney, Agent, or Firm*—Thomas H. Whaley; Carl G. Ries; James J. O'Loughlin

[57] ABSTRACT

Motor fuel composition comprising a mixture of hydrocarbons in the gasoline boiling range containing in combination a minor amount of a substituted asparagine containing the formula:

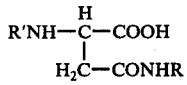

in which R and R′ each represent a secondary or tertiary alkyl or alkylene radical having from about 7 to about 20 carbon atoms and a minor amount of a cyclomatic compound having the formula:

$MA_xB_y$ wherein M is manganese, A is a cyclopentadienyl radical and B is an electron donating group.

6 Claims, No Drawings

MOTOR FUEL COMPOSITION

BACKGROUND OF THE INVENTION

1. Field of the Invention

Modern internal combustion engine design is undergoing important changes to meet stricter standards concerning engine and exhaust gas emissions. A major change in engine design recently adopted is the feeding of blow-by gases from the crankcase zone of the engine into the intake air supply to the carburetor just below the atmosphere as in the past. The blow-by gases contain substantial amounts of deposit-forming substances and are known to form deposits in and around the throttle plate area of the carburetor. These deposits restrict the flow of air through the carburetor at idle and at low speeds so that an overrich fuel mixture results. This condition produces rough engine idling, stalling and also results in excessive hydrocarbon exhaust emissions to the atmosphere.

2. Description of the Prior Art

U.S. Pat. No. 3,773,479 discloses a detergent motor fuel composition containing a substituted asparagine as the effective detergent and its disclosure is incorporated herein.

U.S. Pat. No. 3,127,351 discloses an anti-knock motor fuel composition containing a cyclopentadienyl manganese tricarbonyl compound and this disclosure is incorporated herein.

SUMMARY OF THE INVENTION

A novel motor fuel composition has been discovered which exhibits enhanced carburetor detergency properties due to an unexpected cooperation in a combination of certain additive components. While one of the components, a substituted asparagine, is a well known carburetor detergent, the other additive is not effective as a carburetor detergent.

DESCRIPTION OF THE PREFERRED EMBODIMENTS

The substituted asparagine of the invention is represented by the formula:

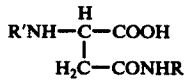

in which R and R' each represents a secondary or teritary alkyl or alkylene radical having from 7 to 20 carbon atoms. In a more preferred embodiment, R and R' represent the same or different secondary alkyl or alkylene radicals having from 12 to 18 carbon atoms. The substituted asparagines are prepared by the reaction of maleic anhydride with a suitable amine according to the following reaction steps:

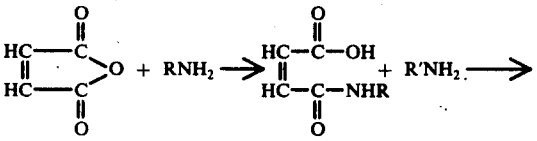

-continued

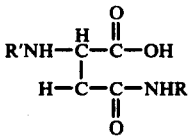

In general a mole of suitable secondary or tertiary hydrocarbyl amine is reacted with maleic anhydride at a moderate temperature preferably dissolved in an organic solvent, such as benzene. Following the initial reaction step the reaction mixture is cooled to temperatures of about 50° C or below and another mole of the hydrocarbylamine added to the reaction mixture. On the completion of this addition, the temperature of the reaction mixture is raised to the usual temperature of the solvent and the mixture refluxed for an extended period until the reaction is complete. Examples of substituted asparagines which are the basic detergent additive in the present invention include:

N,N'-di-$C_{14}$-$C_{15}$ secondary alkyl asparagine
N,N'-di-$C_{10}$-$C_{14}$ secondary alkyl asparagine
N,N'-di-$C_{15}$-$C_{20}$ secondary alkyl asparagine
N,N'-di-$C_7$-$C_9$ secondary alkyl asparagine
N-sec.-octyl,N'-sec. lauryl asparagine
N-sec. nonyl,N'-sec. octadecyl asparagine
N,N'-di-$C_{12}$ tertiary alkyl asparagine
N,N'-di-$C_{18}$ tertiary alkyl asparagine
N-$C_{14-15}$sec. alkyl-N'-$C_{12}$ tertiary alkyl asparagine
N-$C_{12-14}$tert. alkyl-N'-$C_{18-22}$tert. alkyl asparagine
N,N'-di-$C_{11}$-$C_{14}$ sec. alkyl asparagine The cyclomatic compound additive employed in the present fuel composition is represented by the formula:

$$Ma_xB_y$$

wherein M is a metal, namely, manganese; A is a cyclomatic radical, that is, a cyclopentadienyl radical and B is an electron donating group such that $a_n + 5x + py = S$ wherein S is the atomic number of an inert gas of the fourth period; namely, krypton; $x$ is a small whole integer, namely, 1; $y$ is a small whole integer, namely 3; $n$ is a period of the periodic table, namely, the fourth period; s is the number of electrons donated by the electron donating group, namely 2, and a is the atomic number of the metal, namely, 25.

Reference to the generic formula described hereinabove indicates that there are three primary constituents of these additives. They are metallic constituents manganese designated as M, the cyclomatic or cyclopentadienyl radical designated as A and an electron donating group, namely, carbon monoxide, designated as B.

The constituent designated by the symbol A in the formula presented hereinbefore comprises a cyclomatic radical, that is, a cyclopentadiene-type hydrocarbon radical which is a radical containing the cyclopentadienyl moeity. In general such cyclomatic hydrocarbon groups can be represented by the formulae:

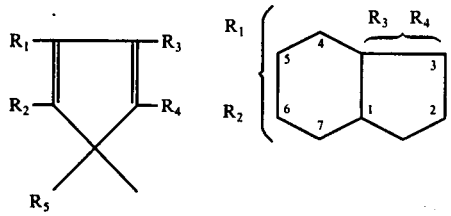

where the R's are selected from the group consisting of hydrogen and univalent organic hydrocarbon radicals.

A preferred class of cyclomatic radicals suitable in the practice of this invention are those which contain from 5 to about 13 carbon atoms. These are exemplified by cyclopentadienyl, indenyl, methylcyclopentadienyl, propylcyclopentadienyl, diethylcyclopentadienyl, phenylcyclopentadienyl, tert-butylcyclopentadienyl, p-ethylphenylcyclopentadienyl, 4-tert-butyl indenyl and the like. The compounds from which these are derived are preferred as they are more readily available cyclomatic compounds and the metallic cyclomatic coordination compound obtainable from them have the more desirable characteristics of volatility and solubility which are prerequisites of superior hydrocarbon additives.

The third primary constituent of the new compositions of matter of the present invention is designated as an electron donating group, namely, carbon monoxide.

Representative compounds for use in the additive combination of the present fuel composition include cyclopentadienyl manganese tricarbonyl, methylcyclopentadienyl manganese tricarbonyl, ethylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl and the like.

The motor fuel composition of the invention comprises a mixture of hydrocarbons boiling in the gasoline boiling range i.e., generally from about 85° to 450° F.

The gasoline motor fuel which is benefitted by the novel detergent additive combination of the invention may be leaded or unleaded and may consist of straight-chain or branched-chain paraffins, cycloparaffins, olefins, and aromatic hydrocarbons and mixture of these. The base fuel can be derived from straight run naphtha, polymer gasoline, natural gasoline or from catalytically cracked or thermally cracked hydrocarbons and catalytically reformed stocks. The hydrocarbon composition and the octane level of the base fuel are not critical. Any conventional motor fuel base may be employed in the practice of this invention.

In general, the additive components of the invention are added to a fuel composition in minor amounts, i.e., amounts effective to provide enhanced detergency of the fuel composition. The substituted asparagine additive is effective in gasoline in an amount ranging from about 0.001 to 5.0 weight percent based on the total fuel composition with an amount ranging from about 0.001 to 0.2 weight percent being preferred. The most effective concentration of this additive component ranges from about 0.002 to 0.10 weight percent.

The cyclomatic compound of cyclopentadienyl manganese tricarbonyl imparts a cooperative effect on the substituted asparagine compound when it is employed in a range from about 0.02 to 3.5 grams per gallon of manganese as a cyclopentadienylmanganese tricarbonyl. The preferred concentration of this additive component is from about 0.05 to 1.0 grams of manganese per gallon of gasoline.

A fuel composition containing the additive combination of the invention can contain other additives normally employed in a fuel composition. For example, the base fuel may be blended with an anti-knock compound, such as tetraalkyl lead compound, including tetraethyl lead, tetramethyl lead, tetrabuyl lead, or mixtures thereof, generally in a concentration from about 0.01 to 4.0 cc. per gallon of gasoline. The tetraethyl lead mixture commercially available for automotive use will also contain an ethylene chlorideethylene bromide mixture as a scavenger for removing lead combustion products from the engine. The fuel composition may also be augmented with anti-icing additives, corrosion inhibitors, intake system deposits modifiers, dispersants, upper cylinder lubricants and the like.

The additive combination of the invention was tested for its effectiveness as a carburetor detergent in the Buick Carburetor Detergency Test. This test is run on a Buick 350 CID V-8 engine equipped with a two-barrel carburetor. The engine is mounted on a test stand and has operating EGR and PCV systems. The test cycle, shown in Table I, is representative of normal road operation. Approximately 300 gallons of fuel and three quarts of oil are required for each run.

Prior to each run the carburetor is completely reconditioned. Upon completion of the run, the throttle plate deposits and the deposits on the area below the throttle plate are visually rated according to a CRC Varnish rating scale (Throttle Plate Merit Rating) where a rating of (1) one describes heavy deposits on the throttle plate and a rating of (10) ten a completely clean plate. The two ratings are averaged to given an average carburetor rating.

TABLE I

1973 BUICK CARBURETOR DETERGENCY TEST OPERATING CONDITIONS

| | Stage I | Stage II | Stage III |
|---|---|---|---|
| Duration, hour | 1 | 3 | 1 |
| Speed, r.p.m. | 650+25 | 1500±25 | 2000±25 |
| Torque, ft.-lbs. | 0 | 80±2 | 108±2 |
| Water Out, ° F. | 205±5 | 205±5 | 205±5 |
| Carburetor Air, ° F. | 140±5 | 140±5 | 140±5 |
| Exhaust Back Pres. in Hg | — | 0.7 ±0.1 | — |
| Man. Vac., In Hg. | 18-20 | 14-17 | 11-13 |
| Fuel flow, Lbs/hr. | ~ 4 | ~ 14 | ~ 20 |
| Test Duration, 120 hours | | | |

The fuel composition employed for testing the detergent additive combination of the invention was an unleaded gasoline base fuel having a Research Octane Number of 91.5. This gasoline consisted of about 22.5% of aromatic hydrocarbons, 10.5% olefinic hydrocarbons and 67.0% paraffinic hydrocarbons and boiled in the range from 90° to 372° F.

Test results obtained employing the detergent additive combination of the invention and comparison test results are given in the Table below.

TABLE II

BUICK CARBURETOR DETERGENCY TEST

| Run | Fuel | Average Carburetor Rating |
|---|---|---|
| 1 | Base Fuel | 3.3 |
| 2 | Base Fuel + 15 PTB[1] N,N'-$di_2C_{15}$-$C_{20}$ secondary alkyl asparagine[2] | 5.5 |

TABLE II-continued

BUICK CARBURETOR DETERGENCY TEST

| Run | Fuel | Average Carburetor Rating |
|---|---|---|
| 3 | Base Fuel + 15 PTB N,N'-di-$C_{15}C_{20}$ secondary alkyl asparagine[2] + 0.125 gm./gal of dicyclopentadiene | 5.1 |
| 4 | Base Fuel + 0.062 gm./gal of manganese as Methylcyclopentadienyl manganese tricarbonyl | 1.8 |
| 5 | Base Fuel + 15 PTB N,N'-di-$C_{15}$-$C_{20}$ secondary alkyl asparagine + 0.0313 gm./gal of manganese as methylcyclopentadienyl manganese tricarbonyl | 6.4 |
| 6 | Base Fuel + 15 OTB N,N'-di-$C_{15}$-$C_{20}$ secondary alkyl asparagine + 0.625 gm,/gal of manganese as methylcyclopentadienyl manganese tricarbonyl | 7.1 |

[1] PTB = pounds of additive per 1000 barrels of fuel.

[2] These fuels also contained 18 PTB of a corrosion inhibitor and 43 PTB of a carrier mineral oil.

The foregoing data shows that the novel fuel composition of the invention was surprising effective in its carburetor detergency properties, a fact which was not predictable from the individual property of a cyclopentadienylmanganese carbonyl.

We claim:

1. A motor fuel composition comprising a mixture of hydrocarbons in a gasoline boiling range containing from about 0.001 to 5.0 weight percent of a substituted asparagine having the formula:

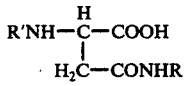

in which R and R' each represent a secondary or a tertiary alkyl or alkylene radical having from about 7 to 20 carbon atoms and from about 0.02 to 3.5 grams per gallon of manganese as a cyclopentadienyl manganese tricarbonyl.

2. A motor fuel composition according to claim 1 in which R and R' represent secondary hydrocarbon radicals and said manganese compound is methylcyclopentadienylmanganese tricarbonyl.

3. A motor fuel composition according to claim 1 in which R and R' represent secondary alkyl radicals having from 12 to 18 carbon atoms and said manganese compound is methylcyclopentadienylmanganese tricarbonyl.

4. A motor fuel composition according to claim 1 containing from about 0.001 to 0.2 weight percent of said substituted asparagine and from about 0.05 to 1.0 grams per gallon of said manganese.

5. A motor fuel composition according to claim 1 in which said hydrocarbon mixture boils in the range from about 85° to 450° F.

6. An unleaded motor fuel composition comprising a mixture of hydrocarbons in a gasoline boiling range containing from about 0.001 to 5.0 weight percent of a substituted asparagine having the formula:

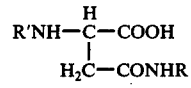

in which R and R' each represent a secondary or a tertiary alkyl or alkylene radical having from about 7 to 20 carbon atoms and from about 0.02 to 3.5 grams per gallon of manganese as a cyclopentadienyl manganese tricarbonyl.

* * * * *